US006782956B1

(12) United States Patent
Seith et al.

(10) Patent No.: US 6,782,956 B1
(45) Date of Patent: Aug. 31, 2004

(54) DRIVE SYSTEM HAVING AN INERTIAL VALVE

(75) Inventors: Warren A. Seith, Bethlehem, PA (US); Louis J. Colangelo, III, Bethlehem, PA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/384,446

(22) Filed: Mar. 7, 2003

(51) Int. Cl.[7] ..... B25D 17/00

(52) U.S. Cl. ..... 173/1; 173/93.5; 173/93.6; 173/93; 173/206

(58) Field of Search ..... 173/93, 93.5, 93.6, 173/169, 117, 205, 1, 168, 206, 207; 81/467, 473; 92/156, 158

(56) References Cited

U.S. PATENT DOCUMENTS 1,042,094 A 10/1912 Demmler
1,045,956 A 12/1912 Demmler (List continued on next page.)

OTHER PUBLICATIONS

Ingersoll–Rand Company, Equi–Pulse Nutrunner Product Description, Air Tool Manual, Apr. 1990, pp. 46 and 47, U.S.A.

Ingersoll–Rand Company, Tool and Hoist Division, Professional Tools Catalog, Power–Pulse Plus Nutrunners, Liberty Corner, NJ, 1997, U.S.A.

*Primary Examiner*—Scott A. Smith
*Assistant Examiner*—Nathaniel Chukwurah
(74) *Attorney, Agent, or Firm*—Michael Best & Friedrich LLP

(57) ABSTRACT

A drive system having a housing and including a frame supported in the housing and defining an axis. The frame is rotatable about the axis and defines an interior space. A piston supported by the frame is moveable axially in the interior space and is rotatable about the axis. The piston divides the interior space and defines first and second chambers and a plurality of channels communicating between the first and second chambers. An inertial valve is coupled to the piston and is moveable between a first orientation, in which a valve stop is spaced a distance from at least one of the plurality of channels to permit lubricant flow along the at least one of the plurality of channels, and a second orientation, in which the valve stop engages the at least one of the plurality of channels.

29 Claims, 15 Drawing Sheets

U.S. PATENT DOCUMENTS 2,580,607 A 1/1952 Schmid
2,591,323 A 4/1952 Webb
2,655,901 A * 10/1953 Brown ..... 91/281
2,720,956 A 10/1955 Coombes
2,747,447 A 5/1956 Burleigh
2,788,768 A * 4/1957 Fischer ..... 91/317
2,801,718 A 8/1957 Kaman
2,814,277 A 11/1957 Jimerson
2,842,994 A 7/1958 Stine
2,850,128 A 9/1958 Sittert
2,863,539 A 12/1958 Yeager
2,947,283 A 8/1960 Roggenburk
3,053,360 A 9/1962 Madsen
3,116,617 A 1/1964 Skoog
3,174,559 A 3/1965 Vaughn
3,195,702 A * 7/1965 Alexander ..... 173/176
3,212,295 A 10/1965 Vaughn
3,214,940 A * 11/1965 Kramer ..... 464/25
3,226,858 A 1/1966 Spannhake
3,253,662 A * 5/1966 Sacchini ..... 173/177
3,254,571 A 6/1966 Kuhn
3,292,391 A * 12/1966 Kramer et al. ..... 464/25
3,319,723 A 5/1967 Kramer
3,321,043 A * 5/1967 Vaughn ..... 184/109
3,323,395 A 6/1967 Burnett et al.
3,468,222 A 9/1969 Cordes et al.
3,491,839 A 1/1970 McIntire
3,668,976 A 6/1972 Hieber et al.
3,719,254 A * 3/1973 Snider ..... 184/64
4,149,602 A 4/1979 James
4,183,414 A * 1/1980 Tamai et al. ..... 173/118
4,368,784 A 1/1983 Wunsch et al.
4,375,181 A 3/1983 Conway
4,381,236 A 4/1983 Cox
4,533,337 A * 8/1985 Schoeps ..... 464/25
4,658,913 A 4/1987 Yantsen et al.
4,735,595 A * 4/1988 Schoeps ..... 464/25
4,867,250 A 9/1989 Ono
5,012,709 A 5/1991 Su
5,083,619 A 1/1992 Giardino et al.
5,249,502 A 10/1993 Radocaj
5,341,723 A 8/1994 Hung
5,542,646 A 8/1996 Bunyan
5,544,710 A * 8/1996 Groshans et al. ..... 173/176
5,673,759 A 10/1997 Biek
6,491,111 B1 12/2002 Livingston et al.

* cited by examiner

DRIVE SYSTEM HAVING AN INERTIAL VALVE

FIELD OF THE INVENTION

The present invention relates to a drive system and, more particularly, to a drive system for a rotary tool.

BACKGROUND OF THE INVENTION

A rotary tool, such as an impact wrench, generally includes a housing supporting a motor, a drive mechanism driven by the motor, an output shaft having a first end adapted to engage a fastener and a second end adapted to engage the drive mechanism. In impact wrenches, the drive mechanism generally includes a hammer member that periodically impacts the output shaft, rotating the output shaft about a central axis to hammer or drive fasteners into or remove fasteners from a work piece.

SUMMARY OF THE INVENTION

The present invention provides a drive system, such as, for example, a drive system for a rotary tool. In one construction of the invention, the drive system includes a frame defining an axis and enclosing an interior space. The interior space houses lubricant. A piston supported by the frame is moveable axially in the interior space and is rotatable about the axis. The piston divides the interior space and defines a first chamber, a second chamber, and a plurality of channels communicating between the first chamber and the second chamber. The piston supports an inertial valve. The inertial valve is moveable between a first orientation, in which at least a portion of the inertial valve is moved away from the plurality of channels to permit lubricant flow along the plurality of channels, and a second orientation, in which the inertial valve sealingly engages the plurality of channels. The inertial valve is moveable between the first orientation and the second orientation in response to movement of the piston along the axis.

In another construction, the drive system includes a housing and a frame supported in the housing and defining an axis. The frame is rotatable about the axis and the frame defines an interior space. A piston supported by the frame is moveable axially in the interior space and is rotatable about the axis. The piston divides the interior space and defines a first chamber, a second chamber, and a plurality of channels communicating between the first chamber and the second chamber. An inertial valve is coupled to the piston. The inertial valve includes a valve stop and a spring. The inertial valve is moveable between a first orientation, in which the valve stop is spaced a distance from at least one of the plurality of channels to permit lubricant flow through the at least one of the plurality of channels, and a second orientation, in which the valve stop engages the at least one of the plurality of channels to substantially block lubricant flow through the at least one of the plurality of channels. The spring biases the valve toward the first orientation.

In still another construction, the drive system has a housing and includes a frame supported in the housing and defining an axis. The frame is rotatable about the axis and the frame defines an interior space and houses lubricant. A piston is supported by the frame and is moveable axially in the interior space between a forward position and a rearward position. The piston divides the interior space and defines a first chamber, a second chamber, and a plurality of channels communicating between the first chamber and the second chamber. An inertial valve is coupled to the piston and is moveable between a first orientation, in which at least a portion of the valve is spaced a distance from at least one of the plurality of channels to permit lubricant flow along the at least one of the plurality of channels, and a second orientation, in which the valve stop engages at least one of the plurality of channels. The inertial valve is moveable between the first orientation and the second orientation in response to movement of the piston between the forward position and the rearward position.

The present invention also provides a method of operating a drive system of a rotary tool.

Other features and advantages of the invention will become apparent to those skilled in the art upon review of the following detailed description, claims, and drawings.

BRIEF DESCRIPTION OF THE DRAWINGS

The present invention is further described with reference to the accompanying drawings, which show constructions of the present invention. However, it should be noted that the invention as disclosed in the accompanying drawings is illustrated by way of example only. The various elements and combinations of elements described below and illustrated in the drawings can be arranged and organized differently to result in constructions which are still within the spirit and scope of the present invention.

In the drawings, wherein like reference numerals indicate like parts.

DETAILED DESCRIPTION

The terms "first", "second", "forward", and "rearward" are used herein and in the appended claims for description only and are not intended to imply any particular orientation, order, or importance.

Figure 1:
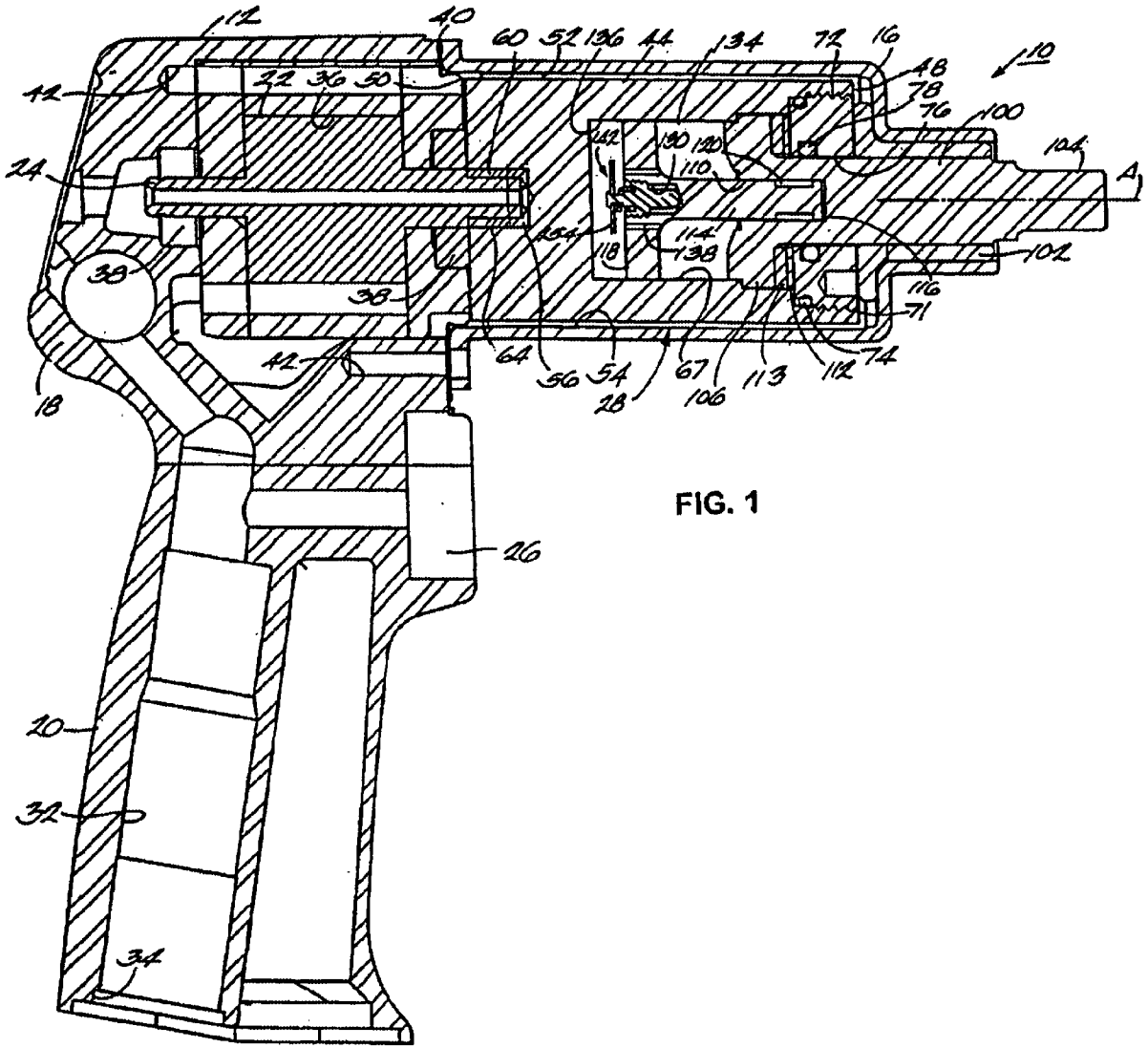
FIG. 1 is a side view, partially in section, of a rotary tool embodying aspects of the present invention.
Figure 2A:
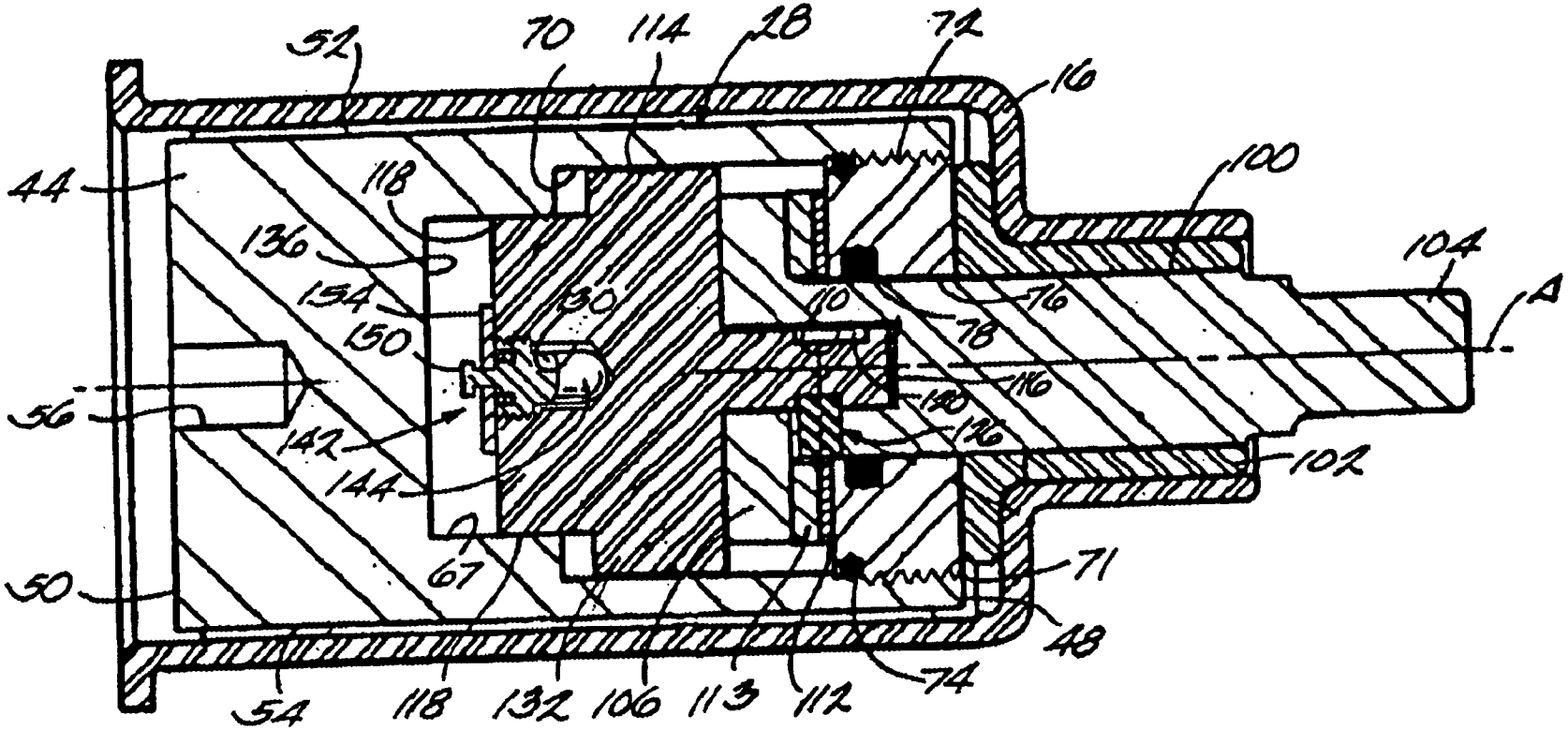
FIGS. 2A and 2B are side views, partially in section, of a rotary drive system of the rotary tool shown in FIG. 1.
Figure 2B:
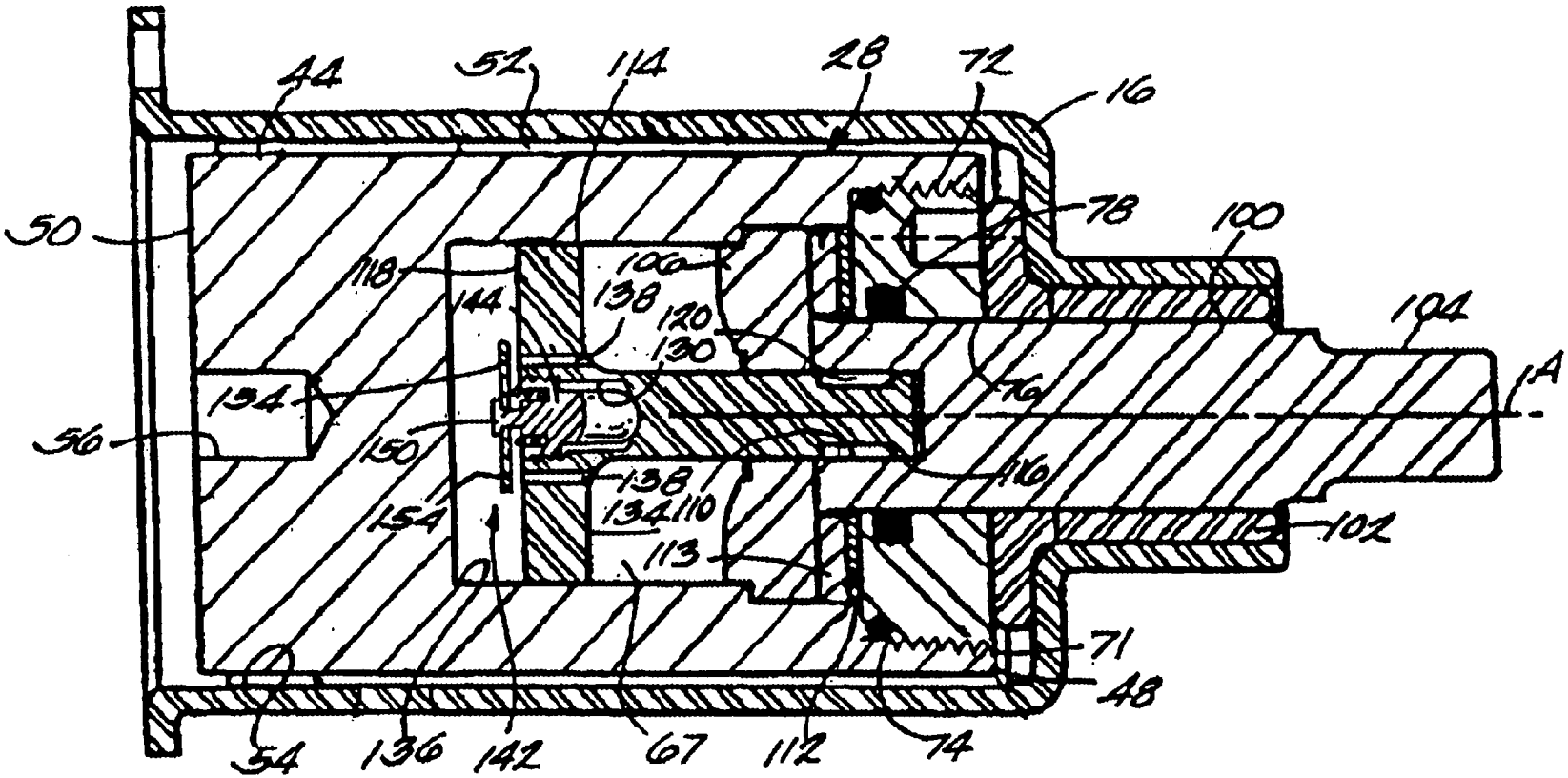

FIG. 1 illustrates a rotary tool 10, such as, for example, an impact wrench embodying aspects of the present invention. The rotary tool 10 includes a housing 12 having a forward portion 16 and a rearward portion 18, an operator's grip or handle 20, a motor 22 (e.g., an air motor or an electric motor) having a motor shaft 24, a trigger 26 operably coupled to the motor 22 to control motor speed, and a rotary drive system 28. The motor shaft 24 defines a central axis A, which extends axially through the rotary tool 10.

The handle 20 includes an air channel 32 having an inlet 34. In some constructions (not shown), the air channel 32 includes seals (e.g., O-rings, washers, etc.), filters (e.g., air strainers), and valves (e.g., spring-operated valves) for controlling air quality in and airflow through the rotary tool 10. Additionally, in some constructions (not shown), the air channel 32 includes a throttle valve (not shown) that is operably connected to the trigger 26 for controlling the flow of air through the air channel 32, the operating speed of the rotary tool 10, and/or the torque generated by the rotary tool 10. Also, in rotary tools 10 having forward and reverse modes, a reverse valve (not shown) may be positioned along the air channel 32 to direct air flow through the motor 22 in either of two directions (i.e., forward and reverse).

The rearward portion 18 of the housing 12 defines a cavity 36 surrounding the motor 22. The motor shaft 24 extends through the cavity 36 along the central axis A and is supported by bearings 38 for rotation relative to the housing 12. In some constructions, the cavity 36 is sealed (e.g., the cavity includes O-rings, washers, valves, etc.) to prevent unintended air exchange with the atmosphere. One having ordinary skill in the art will appreciate that while one type of air motor has been described herein and is shown in the figures, other types of air motors (not shown) could also or alternately be used. In other constructions (not shown), electric motors (not shown) could also or alternately be used.

Fasteners (not shown) extend through the forward portion 16 of the housing 12 and into bores 42 located in the rearward portion 18 of the housing 12, coupling the forward and rearward portions 16, 18 of the housing 12. A seal (e.g., an O-ring, a washer, etc.) 40 is arranged between the forward and rearward portions 16, 18 to prevent airflow into or out of the housing 12 between the forward and rearward portions 16, 18.

The rotary drive system 28 includes a flywheel or frame 44 supported in the forward portion 16 of the housing 12 for rotation about the central axis A. The frame 44 is a substantially cylindrical member having a forward surface 48, a rearward surface 50 substantially parallel to the forward surface 48, and a circumferential wall 52 extending therebetween. Together, the circumferential wall 52 and the interior surface of the forward portion 16 of the housing define a space 54 (shown in FIGS. 1, 2A, 2B, and 9A–9D), which accommodates rotational movement of the frame 44 relative to the forward portion 16 of the housing 12.

The rearward face 50 defines a recess 56 having a number of splines 60 extending radially into the recess 56. A forward end of the motor shaft 24 includes splines 64, which matingly engage corresponding splines 60, operably coupling the frame 44 and the motor shaft 24 for concurrent rotation about the central axis A in either a forward (e.g., clockwise) or rearward (e.g., counterclockwise) direction.

As shown in FIGS. 1, 2A, 2B, 3, 5, and 9A–9D, the forward and rearward surfaces 48, 50 of the frame 44 define an internal space 67 housing a quantity of lubricant (not shown). Axial grooves 70 (shown in FIGS. 2A, 3, 5, and 9A–9D) extend into the circumferential wall 52 and communicate with the internal space 67. In the illustrated construction, the frame 44 includes two axial grooves 70 spaced approximately 180 degrees apart. In other constructions (not shown), the frame 44 can include one, three, or more axial grooves 70 and the axial grooves 70 can be arranged in any of a number of configurations and orientations.

The forward surface 48 defines a forward opening 71 communicating with the interior space 67. A cover 72 is coupled to (e.g., threaded into, clamped onto, or otherwise fastened to) the forward surface 48 to seal the internal space 67. In the illustrated construction, the cover 72 is threaded into forward surface 48 and a seal 74 (e.g., an O-ring, a washer, etc.) is clamped between the frame 44 and the cover 72 to prevent fluid exchange between the internal space 67 and the space 54. The cover 72 also defines an internal opening 76 opening along the central axis A and including a seal 78.

As shown in FIG. 1, an output shaft or anvil 100 extends through the cover 72 and is supported in the forward portion 16 of the housing 12 by bushing 102 for rotation about the central axis A. However, in other constructions (not shown) other support structure, such, as for example, bearings can also or alternately support the output shaft 100. Additionally, in other constructions (not shown) the output shaft 100 can be arranged to rotate about a second axis that is substantially parallel, or alternatively, at an angle relative to the central axis A.

The output shaft 100 is substantially cylindrical and includes a forward or tool engaging end 104 that is adapted to support a fastener (e.g., a bolt, a screw, a nut, etc.) and/or a fastener engaging element (e.g., a socket). A base portion 106 of the output shaft 100 extends into the internal space 67 and includes two rearwardly extending cams 108. In other constructions (not shown), the base portion 106 can include one, three, or more cams 108. The base portion 106 is held in the internal space 67 by the cover 72 for rotation about the central axis A. The base portion 106 also defines an aperture 110 that extends axially into the output shaft 100 along the central axis A.

As shown in FIGS. 1, 2A, 2B, 3, and 9A–9D, in some constructions, hardened washers 112 are positioned between the cover 72, the base portion 106 and/or the circumferntial surface 52 to prevent lubricant from exiting the internal space 67 via the forward opening 71. Additionally, in the illustrated construction, a friction-reducing member 113 (e.g., bearings, low-friction washers, etc.) is positioned between the cover 72 and the base portion 106.

A piston (shown in FIGS. 1, 2A, 2B, 3, 6A–6D, 9A–9D, and 10A–10D) 114 includes a first end 116 and a second end 118 and is supported in the internal space 67 for rotational movement with the frame 44 about the central axis A and for reciprocating movement relative to the frame 44 along the central axis A. The first end 116 of the piston 114 is substantially cylindrical and is rotatably received in the aperture 110 at the base 106 of the output shaft 100. A notch 120 extends circumferentially around the first end 116. As shown in FIGS. 3, 6A, 6C, and 10A–10D, a forward end 122 of the notch 120 is contoured. More particularly, the contoured forward end 122 includes a single protrusion 124. In other constructions (not shown), the contoured end 122 can include two, three, or more protrusions.

Figure 7B:
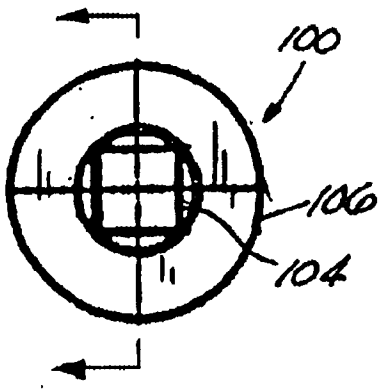
FIGS. 7A–7D illustrate an output shaft of the rotary drive system shown in FIGS. 2A and 2B.
Figure 7A:
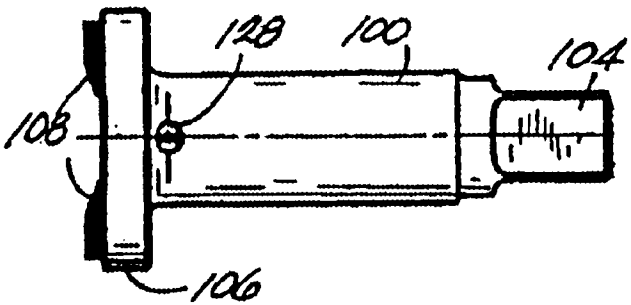
Figure 7C:
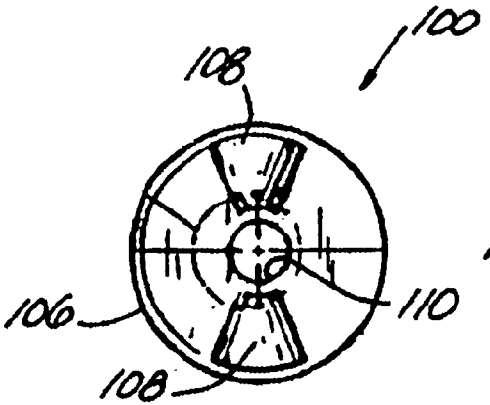
Figure 7D:
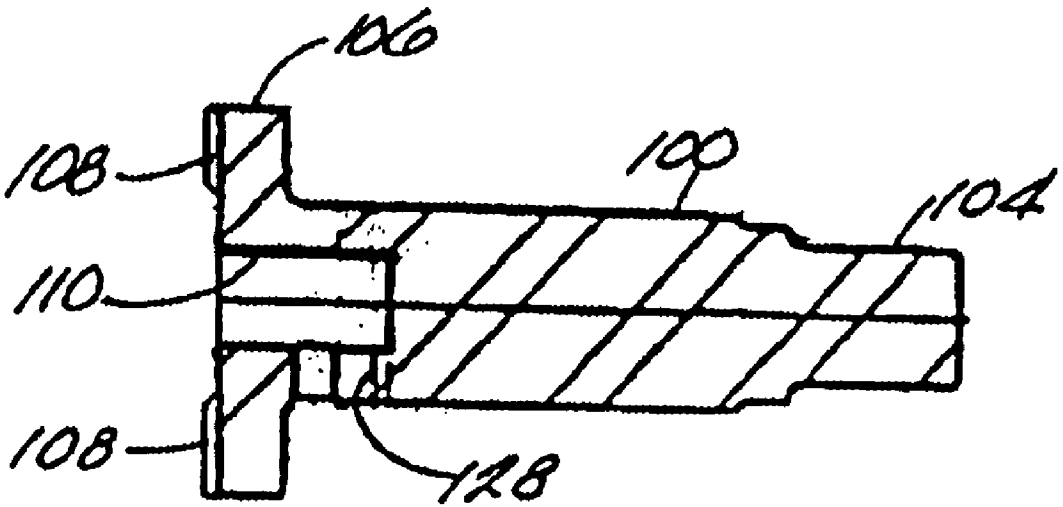

A fastener (e.g., a set screw, a key, a snap ring, etc.) and/or a protrusion 126 extends through an opening 128 (see FIGS. 3, 7A, and 7D) in the output shaft 100 and engages the notch 120 on the first end 116 of the piston 114 to slidably and rotatably couple the output shaft 100 and the piston 114. Together, the notch 120 and the fastener 126 limit axial movement of the piston 114 along the output shaft 100. More particularly, the piston 114 is moveable along the central axis A between a fully retracted position (shown in FIG. 9A) and a fully extended position (shown in FIG. 9B) and the distance between the fully retracted and fully extend positions is approximately equal to the axial length of the notch 120 and the height of the cams 108. Additionally, the mating engagement of the fastener 126 and the notch 120 facilitate relative rotational motion between the piston 114 and the output shaft 100.

Figure 3:
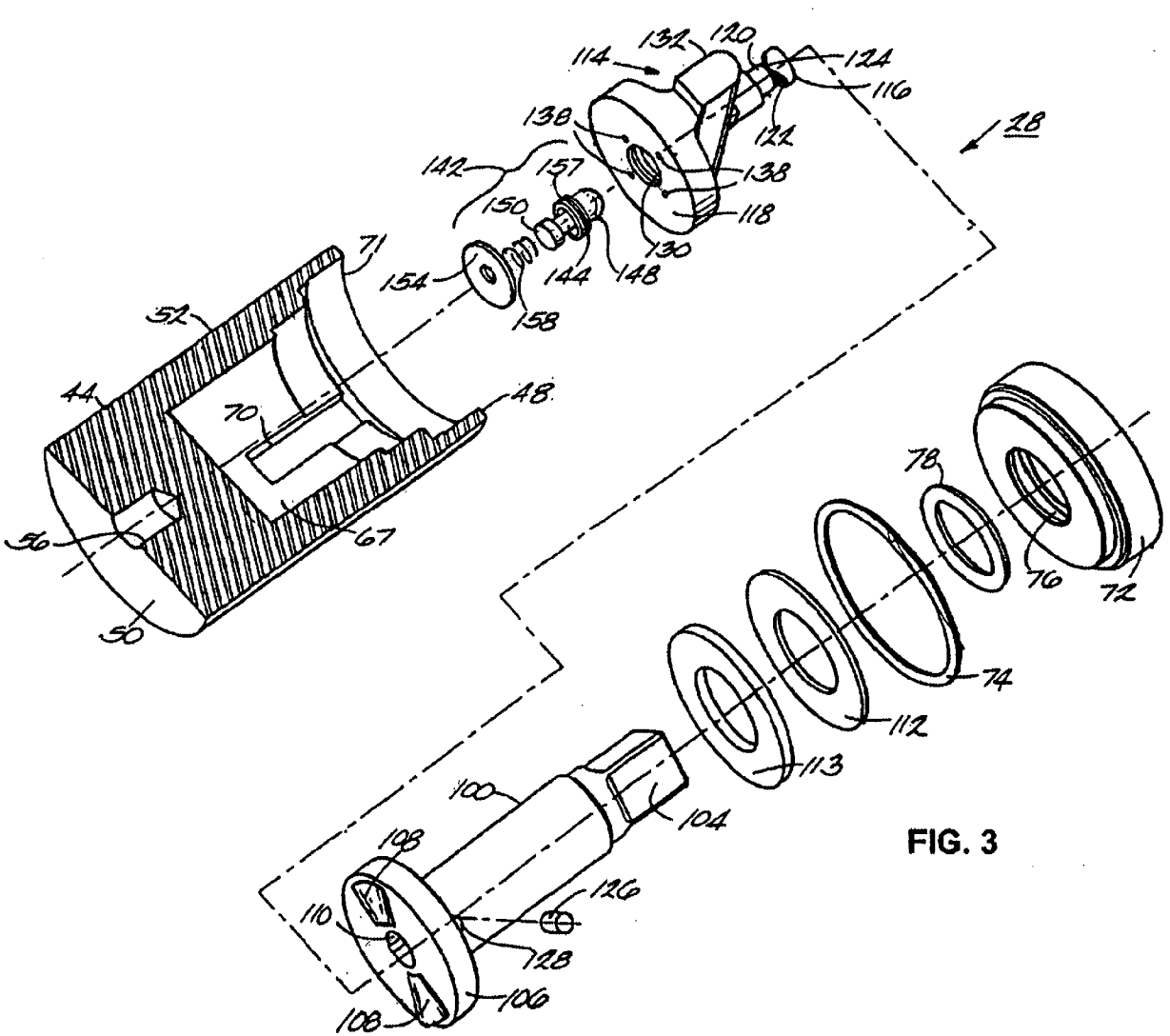
FIG. 3 is an exploded view, partially in section, of the rotary drive system shown in FIGS. 2A and 2B.
Figure 4:
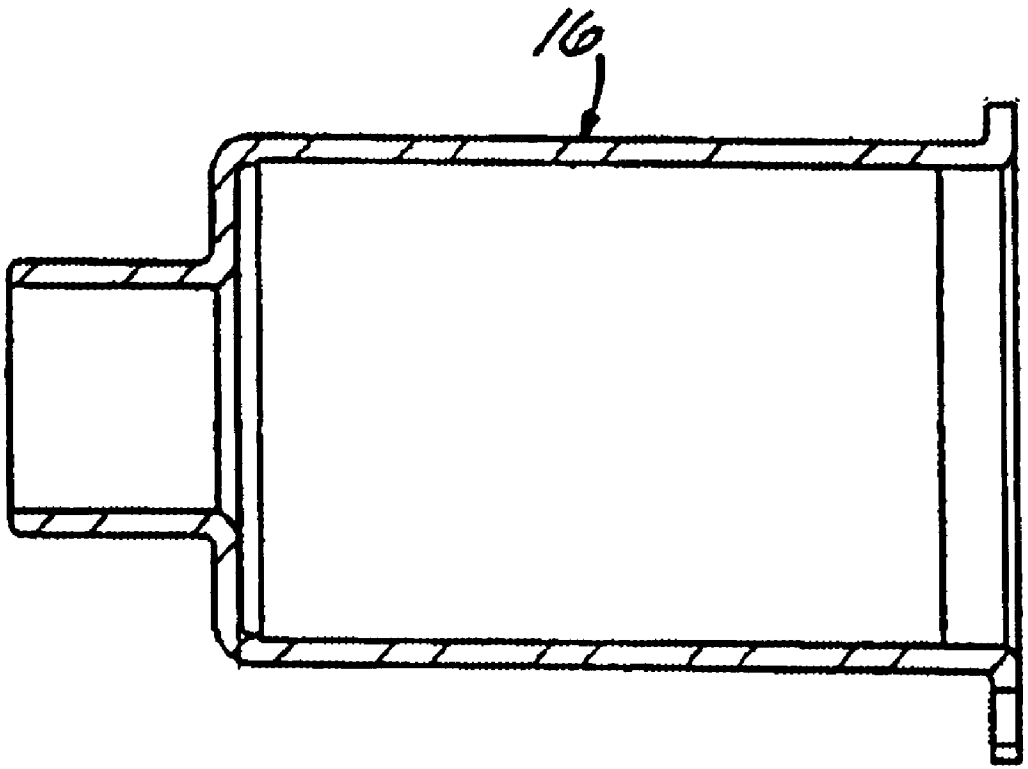
FIG. 4 is a side view, partially in section, of a housing of the rotary drive system shown in FIGS. 2A and 2B.
Figure 5:
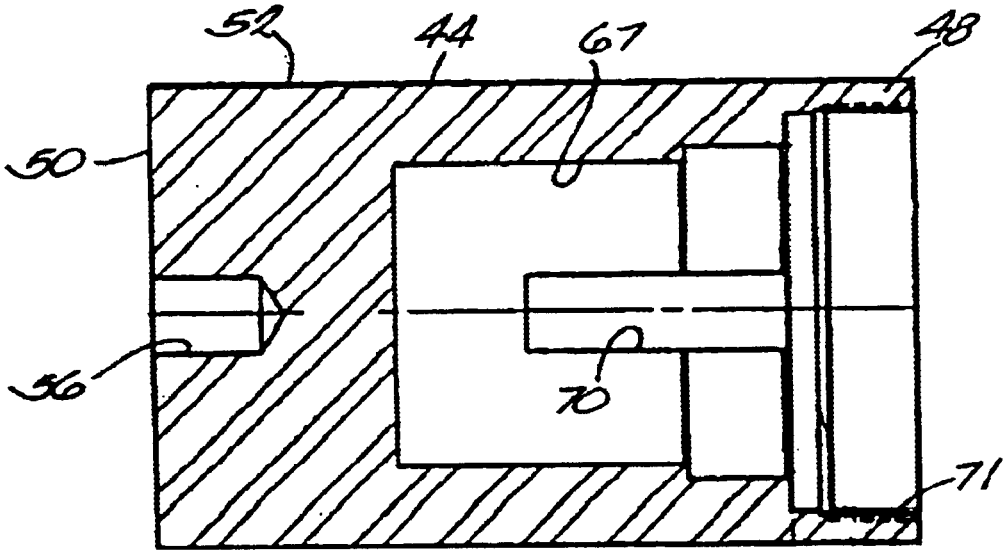
FIG. 5 is a side view, partially in section, of a frame of the drive system shown in FIGS. 2A and 2B.
Figure 6D:
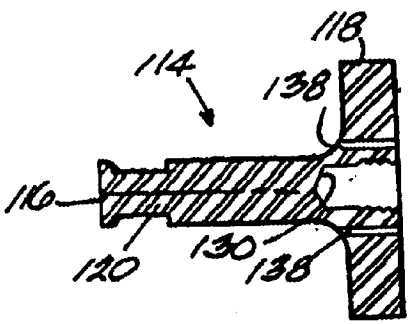
FIGS. 6A–6D illustrate a piston of the rotary drive system shown in FIGS. 2A and 2B.
Figure 6B:
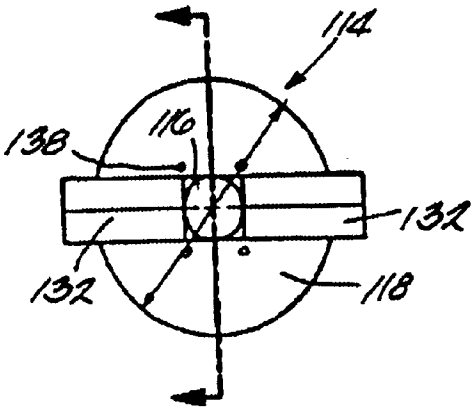
Figure 6A:
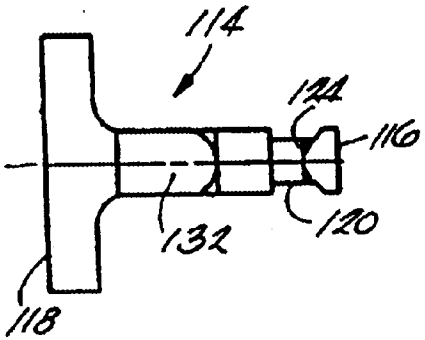
Figure 6C:
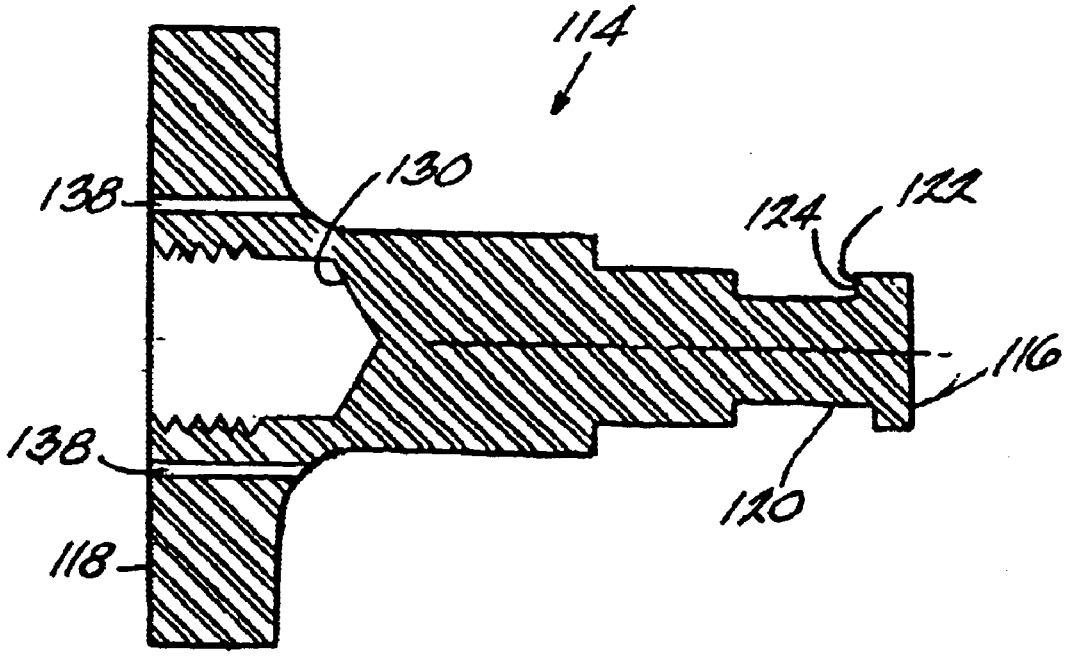

As shown in FIGS. 3 and 6B, the second end 118 of the piston 114 is substantially cylindrical. A blind bore 130 extends axially through the second end 118 of the piston 114. As shown in FIGS. 2A, 3, 6A, 6B, 9A–9D, and 10A–10D, arms 132 (two arms 132 are shown) extend radially from the piston 114 between the first and second ends 116, 118. In other constructions (not shown), the piston 114 can include one, three, or more arms 132. The arms 132 engage the axial grooves 70, facilitating the transfer of rotational motion from the frame 44 to the piston 114. Additionally, as described below, the arms 132 are moveable along the axial grooves 70 to facilitate axial movement of the piston 114 relative to the frame 44. The mating engagement between the arms 132 and the axial grooves 70 also prevents the piston 114 from pivoting about the central axis A relative to the frame 44 and limits axial movement of the piston 114 in the frame 44.

As shown in FIGS. 1, 2A, 2B, and 9A–9D, the second end 118 of the piston 114 divides the internal space 67 into a first or forward chamber 134 and a second or rearward chamber 136. Lubricant is moveable between the first and second chambers 134, 136 along channels 138. In the illustrated construction, four channels 138 extend axially through the second end 118 of the piston 114, fluidly connecting the first and second chambers 134, 136. However, one having ordinary skill in the art will appreciate that in other constructions, the piston 114 can include one, two, three, or more channels 138.

Figure 8:
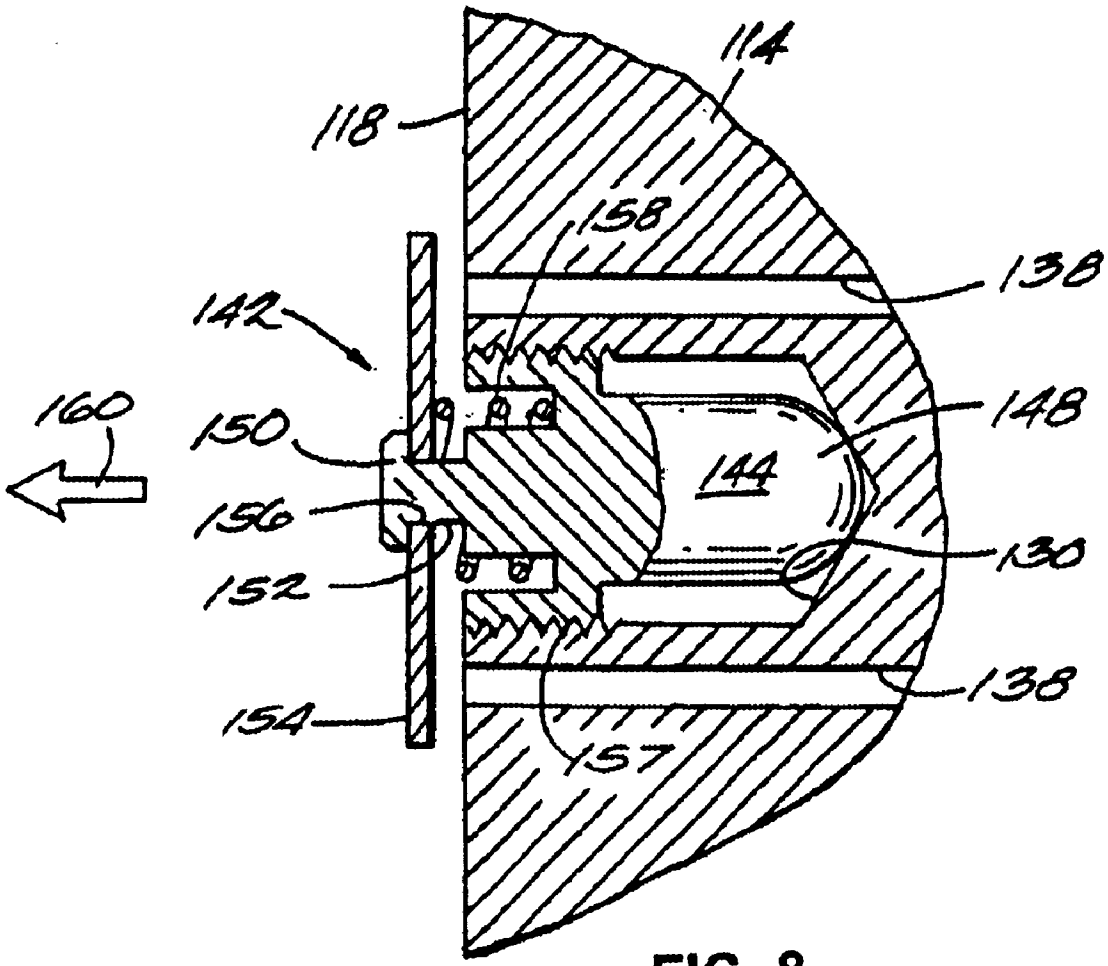
FIG. 8 illustrates an inertial valve of the rotary drive system shown in FIGS. 2A and 2B.

The second end 118 of the piston 114 supports an inertial valve 142 having a stem 144. As explained in greater detail below, the inertial valve 142 is moveable between a first or open orientation and a second or closed orientation. In the illustrated construction, the stem 144 is a threaded plug. However, in other constructions, other fasteners, such as, for example, bolts, screws, and the like can also or alternately be used. With reference to FIG. 8, the stem 144 includes a first or forward end 148, which is threaded into the blind bore 130, and a second or rearward end 150, which extends rearwardly from the second end 118 of the piston 114. The stem 144 is described hereafter and is shown in the figures as a single integral member. However, one having ordinary skill in the art will appreciate that in other constructions (not shown), the stem 144 can be formed of two or more separate and distinct members coupled together (e.g., threaded into one another, welded together, held together by a fastener, etc.).

With reference to FIG. 8, the rearward end 150 of the stem 144 defines a radial slot 152, which supports a valve stop 154 having a central aperture 156. As explained in greater detail below, the valve stop 154 is slideable axially along the slot 152 between a first or open position (shown in FIGS. 1, 2B, 8, 9A, 9B, and 9D) and a second or closed position (shown in FIGS. 2A and 9C). When the valve stop 154 is in the closed position, which corresponds with the closed orientation of the inertial valve 142, the valve stop 154 extends across the rearward openings of the channels 138, preventing lubricant from flowing along the channels 138 between the forward and rearward chambers 134, 136. When the valve stop 154 is in the open position, which corresponds with the open orientation of the inertial valve 142, the valve stop 154 is spaced a distance away from the rearward openings of the channels 138, allowing lubricant to flow through the channels 138 between the forward and rearward chambers 134, 136. In the illustrated construction, the distance between the open and closed positions is substantially equal to the distance between the rearward end of the slot 152 and the rearward end 118 of the piston 114.

As shown in FIGS. 3 and 8, a rib 157 extends outwardly and rearwardly from a central portion of the stem 144. The rib 157 supports a first or forward end of a spring 158. A second or rearward end of the spring 158 engages the valve stop 154. In the illustrated construction, the spring 158 is a compression spring. However, one having ordinary skill in the art will appreciate that in other constructions, other springs (e.g., torsion springs, leaf springs, etc.) can also or alternately be used. The spring 158 applies a rearward force (represented by arrow 160 in FIG. 8) to the valve stop 154. As explained in greater detail below, the rearward force 160 biases the valve stop 154, toward the open position and biases the valve 142 toward the open orientation.

During operation of the rotary tool 10, the tool engaging end 104 (or a fastener engaging element coupled to the tool engaging end 104) is positioned to matingly engage a fastener (e.g., a nut, a bolt, a screw, etc.). To tighten the fastener or thread the fastener into a work piece (not shown), the rotary tool 10 is operated in a forward mode and to loosen the fastener or unthread the fastener from the work piece, the rotary tool 10 is operated in a reverse mode. FIGS. 9A–9D and 10A–10D and the following description refer to operation of the rotary tool 10 in the forward mode. However, one having ordinary skill in the art will appreciate that the rotary tool 10 of the present invention can also or alternately be operated in a reverse mode and that operation of the rotary tool 10 in the reverse mode is substantially similar to operation of the rotary tool 10 in the forward mode.

To initiate operation of the rotary tool 10, an operator depresses the trigger 26, causing power in the form of compressed air or electricity to energize the motor 22 and to rotate the motor shaft 24 in a forward direction (represented by arrow 166 in FIGS. 9A–9D and 10A–10D) about the central axis A. The motor shaft 24 transfers rotational motion to the rotary drive system 28 via the mating engagement of splines 60, 64.

Figure 9A:
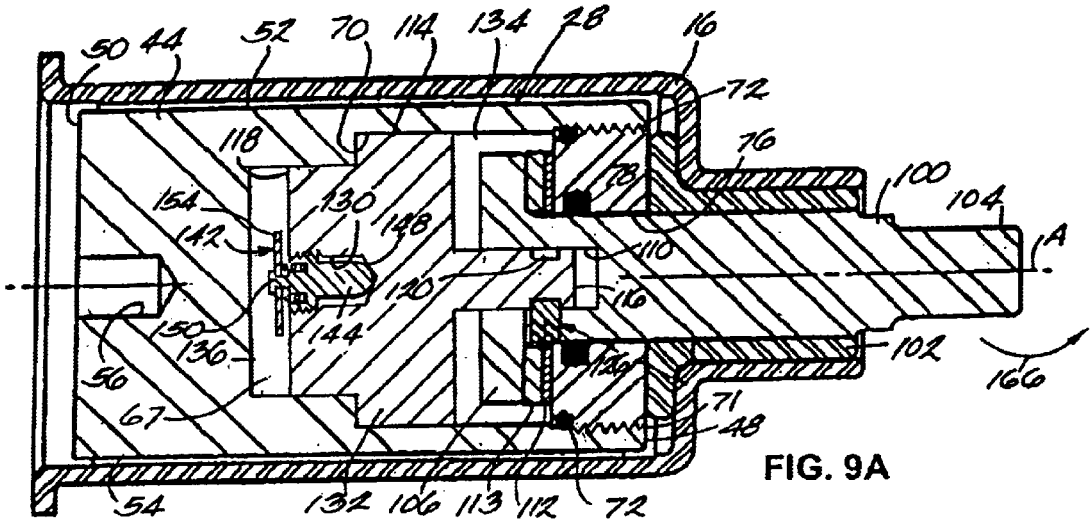
FIG. 9A–9D illustrate the rotary drive system shown in FIGS. 2A and 2B in first, second, third, and fourth orientations, respectively.
Figure 10A:
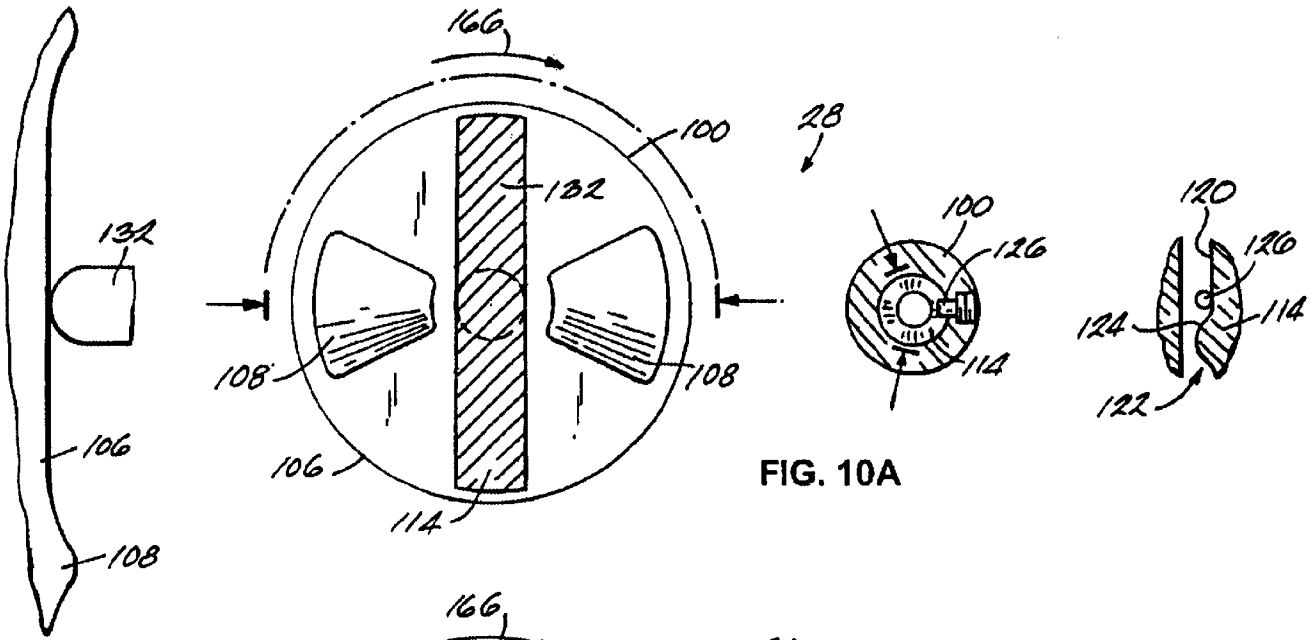
FIGS. 10A–10D illustrate the rotary drive system shown in FIGS. 2A and 2B in first, second, third, and fourth orientations, respectively.

With reference first to FIGS. 9A and 10A, the piston 114 is in a fully retracted position (i.e., the piston 114 is in a rearward-most position in the internal space 67), and the fastener 126 is in a rearward-most position of the notch 120. Additionally, the valve 142 is in the open orientation and the valve stop 154 is in the open position, allowing lubricant to moving along the channels 138 between the forward and rearward chambers 134, 136. More particularly, the forward force 160 of the spring 158 biases the valve stop 154 rearwardly away from the rearward end 118 of the piston 114. Also, the pressure of the lubricant in the forward and rearward chambers 134, 136 is approximately equal.

As the motor 22 begins to rotate the frame 44 about the central axis A, the frame 44 transfers rotational motion to the piston 114 via the mating engagement between the arms 132 and the grooves 70. The notch 120 on the first end 116 of the piston 114 travels along the fastener 126 as the piston 114 rotates about the central axis A. As the contoured end 122 of the notch 120 travels across the fastener 126, the fastener 126 pulls the piston 114 forward along the central axis A toward the base portion 106 of the output shaft 100. In this manner, the piston 114 simultaneously rotates about the central axis A in the forward direction 146 and moves forward along the central axis A toward the output shaft 100.

As shown in FIGS. 9A and 10A, as the piston 114 begins to rotate about the central axis A and to move forwardly along the central axis A, the valve stop 154 remains in the open position, allowing lubricant to move along the channels 138 between the forward and rearward chambers 134, 136. Additionally, as the piston 114 moves forwardly, the area of the forward chamber 134 is reduced and the area of the rearward chamber 136 is increased. In the illustrated construction, the channels 138 are sized to facilitate movement of lubricant from the forward chamber 134 to the rearward chamber 136 and to maintain the lubricant in the forward and rearward chambers 134, 136 at an approximately equal pressure.

Figure 9B:
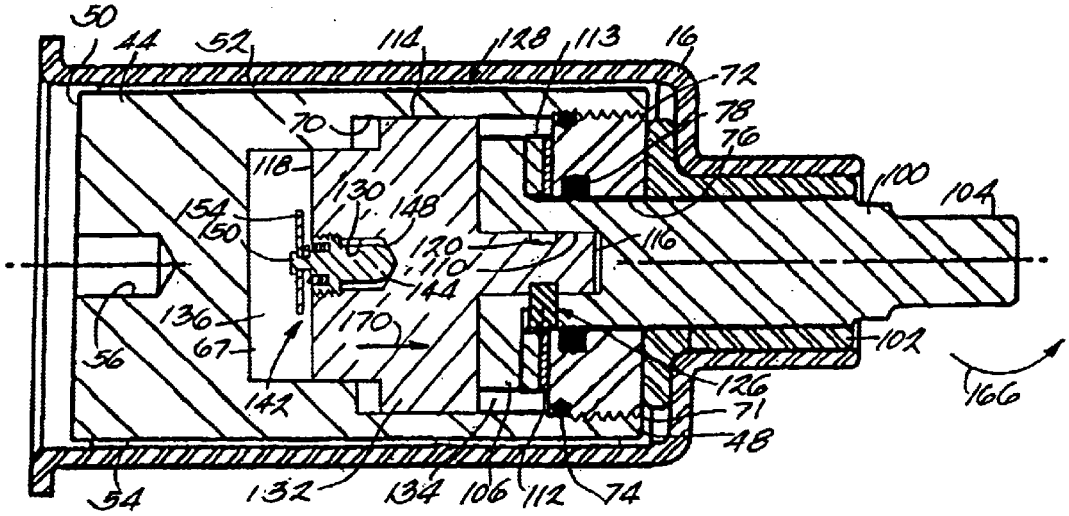
Figure 10B:
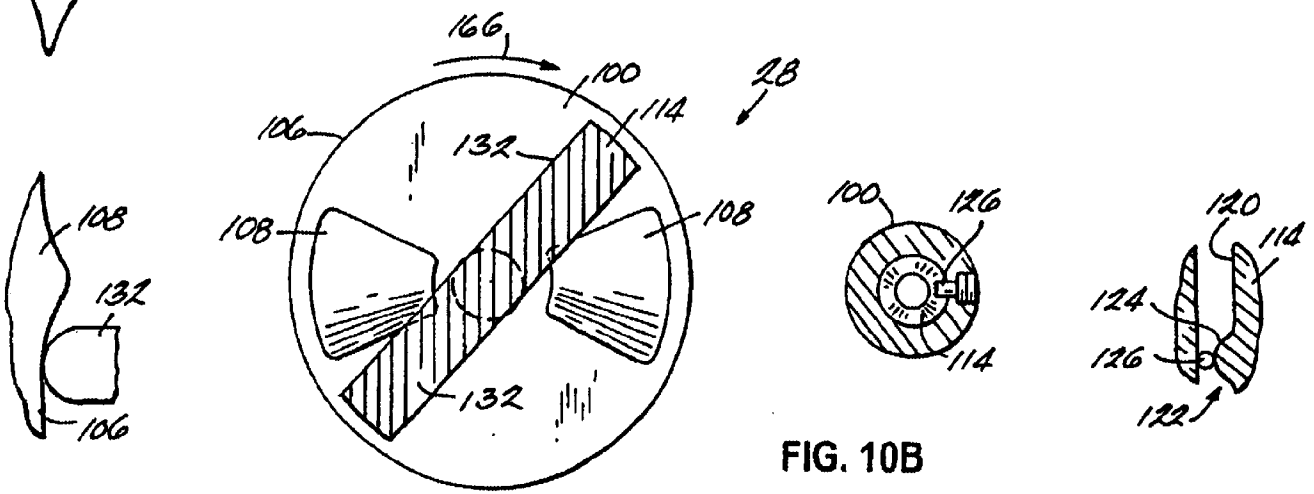

As shown in FIGS. 9B and 10B, as the piston 114 continues to rotate about the central axis A, the fastener 126 rides along the contoured end 122, moving the piston 114 forwardly along the central axis A to a forward-most position (shown in FIGS. 9B and 10B). When the piston 114 is in the forward-most position, the arms 132 contact the base 106 of the output shaft 100. In the illustrated construction, the contoured end 122 of the notch 120 includes a single protrusion 124. In this construction, each time the piston 114 rotates about the central axis A, the fastener 126 engages the protrusion 124 once. More particularly, each time that the piston 114 rotates about the central axis A, the engagement between the protrusion 124 and the fastener 126 causes the arms 132 to contact the cams 108. In other constructions (not shown), the notch 120 can have two, three, or more protrusions 124 for causing the arms 132 to contact the cams 108 two or more times for each rotation of the piston 114 about the central axis A.

Figure 9C:
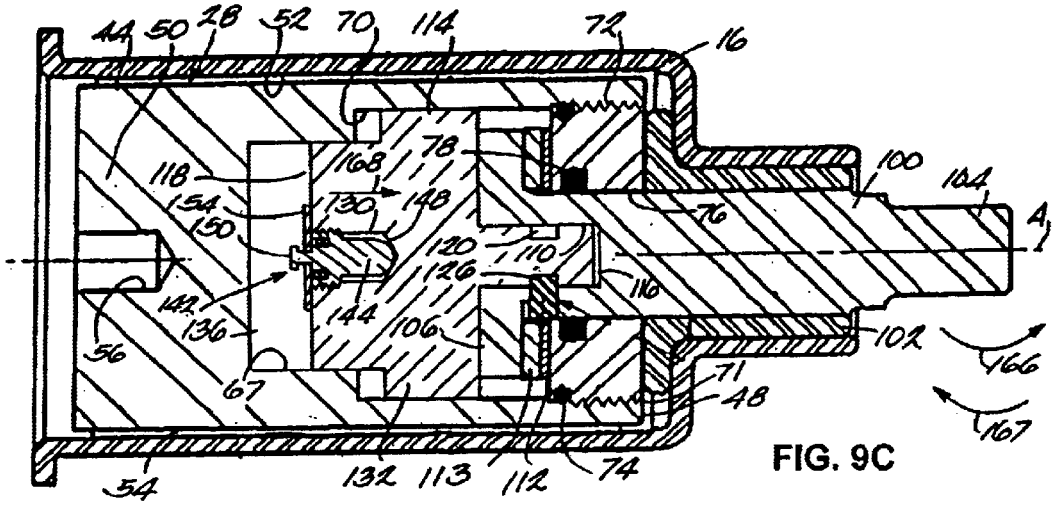
Figure 10C:
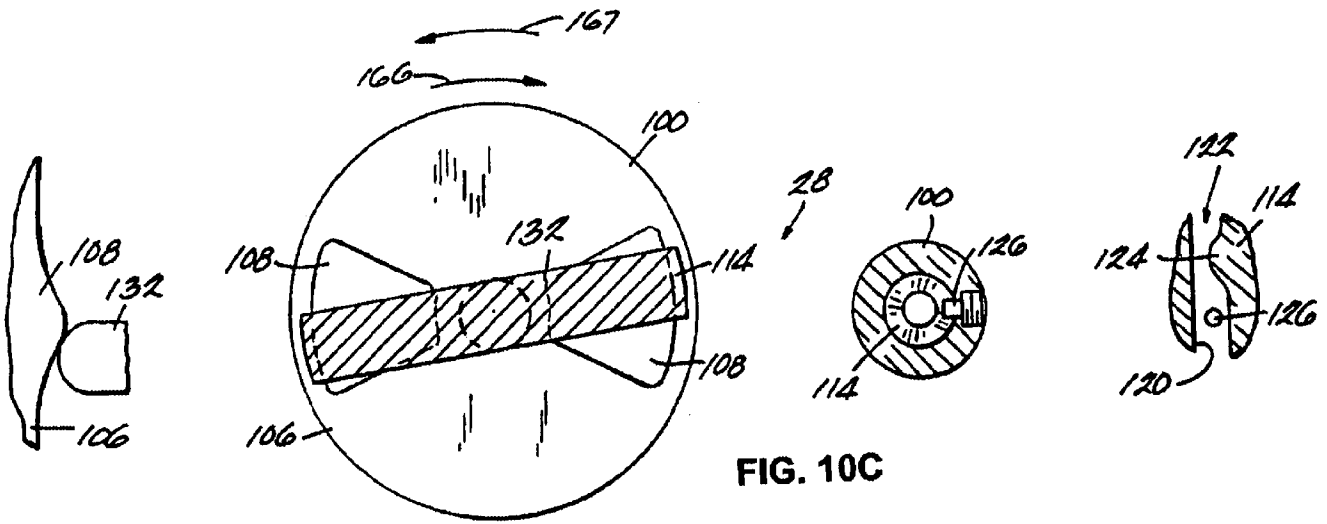

With reference to FIGS. 9C and 10C, as the piston 114 rotates about the central axis A, the arms 132 are rotated into engagement with the cams 108 on the base 106 of the output shaft 100. The impact between the arms 132 and the cams 108 transfers an impulse or force from the piston 114 to the output shaft 100, causing the output shaft 100 to rotate about the central axis A in the forward direction 146. The impact between the arms 132 and the cams 108 also momentarily stops the forward rotation of the piston 114 about the central axis A. Additionally, in the illustrated construction, the impact between the arms 132 and the cams 108 causes the piston 114 to move rapidly along the central axis A in the rearward direction and to rotate a relatively short distance about the central axis A in a reverse direction (represented by arrow 167 in FIGS. 9C and 10C). The impact causes the piston 114 to accelerate at an increasing rate in the reverse direction 167. The inertial mass (represented by arrow 168 in FIG. 9C) of the valve stop 154 prevents and/or slows the rearward motion of the valve stop 154. In this manner, the valve stop 154 does not move rearwardly at the same rate as the piston 114 so that as the piston 114 moves rearwardly, the rearward end 118 of the piston 114 contacts the valve stop 154, moving the valve 142 into the closed orientation.

In the illustrated construction, the inertial force 168 is greater than the rearward force 160 of the spring 158. In this manner, the inertial force 168 maintains the valve stop 154 in close proximity with the rearward end 118 of the piston 114, compressing the spring 158 and maintaining the valve 142 in the closed orientation. As shown in FIG. 9C, the valve stop 154 is in sealing engagement with the rearward ends of the channels 138 (i.e., in the closed position).

Figure 9D:
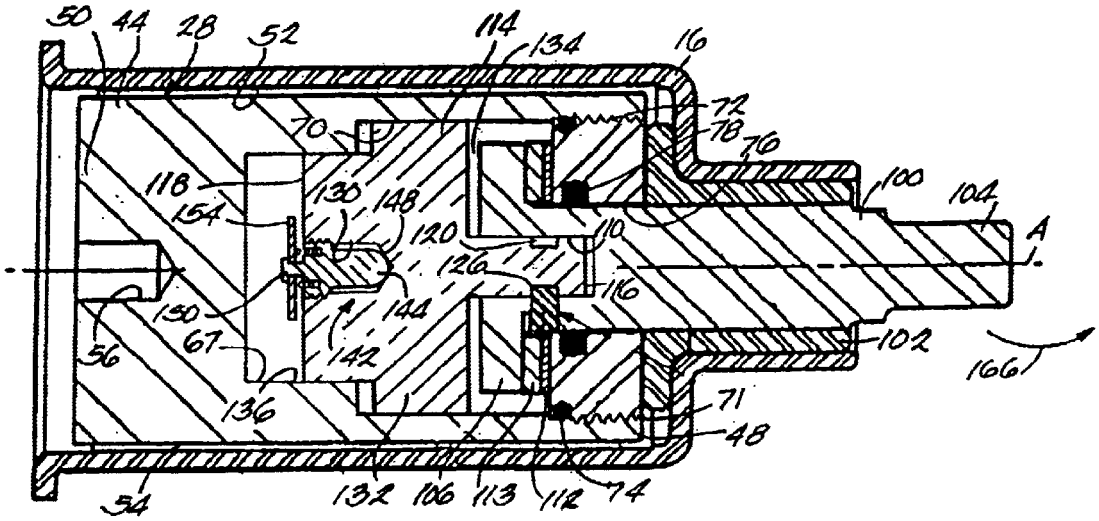

After the initial impact between the arms 132 and the cams 108, the forward rotation of the frame 44 about the central axis A causes the arms 132 to remain in contact with the cams 108 to transfer rotational energy to the output shaft 100. Additionally, after the initial impact, the motor 22 continues to rotate the frame 44 and the piston 114 in the forward direction 166, maintaining the arms 132 in engagement with the cams 108. At this point, the rotational velocity of the piston 114 is relatively constant. Similarly, the rearward motion of the valve stop 154 is relatively constant. In this manner, as shown in FIG. 9D, the inertial force 168 is reduced. The spring force 158 overcomes the inertial force 168 and biases the valve stop 154 toward the open position.

Figure 10D:
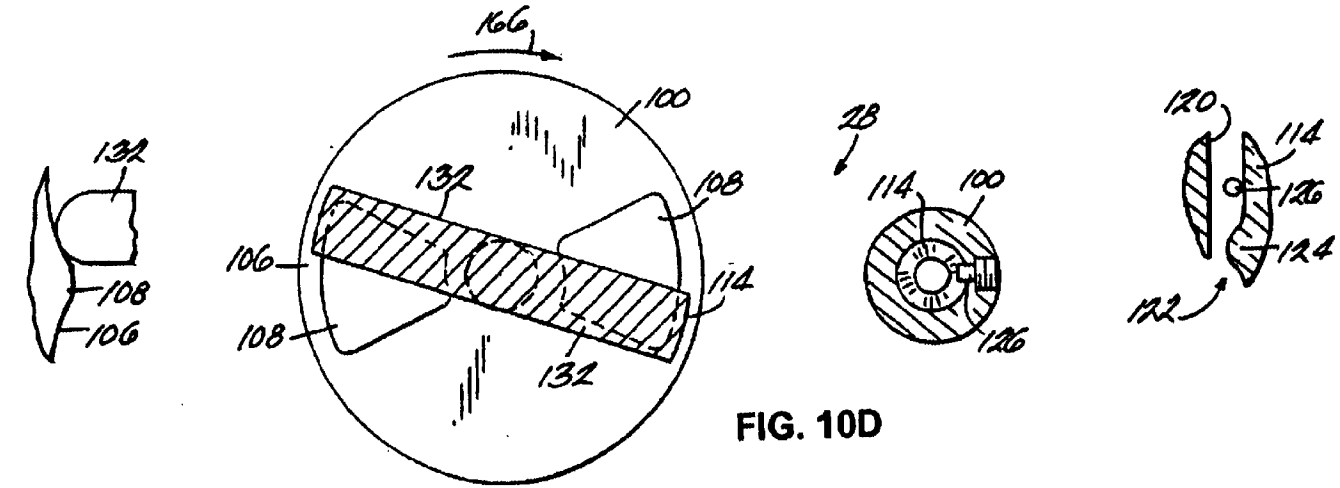

As shown in FIGS. 9D and 10D, once the arms 132 are rotated out of engagement with the cams 108, the piston 114 begins to move rearwardly and the rearward force 160 of the spring 158 forces the valve stop 154 rearwardly with respect to the rearward end 118 of the piston 114. The rearward force 160 moves the valve stop 154 from the closed position toward the open position and moves the valve 142 from the closed orientation toward the open orientation.

As the piston 114 continues to rotate about the central axis A, lubricant moves through the channels 138 from the rearward chamber 136 to the forward chamber 134, maintaining the pressure in the forward and rearward chambers 134, 136 at an approximately equal value. In this manner, the piston 114 encounters minimal resistance as the piston 114 moves axially toward the rearward-most position. Additionally, as the piston 114 begins to move rearwardly along the central axis A, the arms 132 rotate out of engagement with the cams 108 of the output shaft 100.

After the piston 114 returns to the rearward-most position, the piston 114 continues to rotate with the frame 44 about the central axis A until the engagement between the notch 120 and the fastener 126 causes the piston 114 to move forwardly along the central axis A. In the illustrated construction, the piston 114 rotates approximately 200 degrees about the central axis A before the fastener 126 engages the protrusion 124 to re-initiate forward motion of the piston 114. However, as explained above, in other constructions (not shown), the notch 120 can include two, three, or more protrusions 124. In these constructions, the piston 114 can rotate less than 200 degrees before the mating engagement between the fastener 126 and one of the protrusions 124 causes the piston 114 to move forwardly along the central axis A.

The constructions described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, one having ordinary skill in the art will appreciate that the size and relative dimensions of the individual parts of the rotary tool and the drive system can be changed significantly without departing from the spirit and scope of the present invention.

As such, the functions of the various elements and assemblies of the present invention can be changed to a significant degree without departing from the spirit and scope of the present invention.

What is claimed is:

1. A drive system comprising:

a frame defining an axis and enclosing an interior space, the interior space housing lubricant; and a piston supported by the frame and being moveable axially in the interior space and rotatable about the axis, the piston dividing the interior space and defining a first chamber, a second chamber, and a plurality of channels communicating between the first chamber and the second chamber, the piston supporting an inertial valve, the inertial valve being moveable between a first orientation, in which at least a portion of the inertial valve is spaced apart from at least one of the plurality of channels to permit lubricant flow along the at least one of the plurality of channels, and a second orientation, in which the inertial valve sealingly engages the at least one of the plurality of channels, the inertial valve being moveable between the first orientation and the second orientation in response to movement of the piston along the axis.

2. The drive system of claim 1, wherein the inertial valve includes a spring, the spring biasing the inertial valve toward the first orientation.

3. The drive system of claim 2, wherein the piston is rotatable about the axis in a first rotational velocity and a second rotational velocity, the second rotational velocity being greater than the first rotational velocity, the spring biasing the inertial valve toward the first orientation when the piston is rotated at the second rotational velocity, and wherein the inertial valve is moveable toward the second orientation when the piston is rotated at the first rotational velocity.

4. The drive system of claim 1, wherein the inertial valve includes a valve stop, the valve stop being sealingly engageable with the piston to seal the at least one of the plurality of channels when the inertial valve is in the second orientation and being moveable away from the piston when the inertial valve is moved toward the first orientation.

5. The drive system of claim 4, wherein the inertial valve includes a spring, the spring biasing the valve stop away from the piston when the inertial valve is in the first orientation.

6. The drive system of claim 1, wherein the drive system is supported in a housing of a rotary tool, the housing having a forward end, the rotary tool including a motor supported in the housing and having a motor shaft and an output shaft supported in the forward end, and wherein the frame is coupled to the motor shaft and is rotatable relative to the housing about the axis in response to rotation of the motor shaft.

7. The drive system of claim 6, wherein the piston is engageable with the output shaft to hammer the output shaft about the axis.

8. A drive system having a housing, the drive system comprising:

a frame supported in the housing and defining an axis, the frame being rotatable about the axis, the frame defining an interior space;

a piston supported by the frame and being moveable axially in the interior space and rotatable about the axis, the piston dividing the interior space and defining a first chamber, a second chamber, and a plurality of channels communicating between the first chamber and the second chamber; and an inertial valve coupled to the piston, the inertial valve including a valve stop and a spring, the inertial valve being moveable between a first orientation, in which the valve stop is spaced a distance from at least one of the plurality of channels to permit lubricant flow through the at least one of the plurality of channels, and a second orientation, in which the valve stop sealingly engages the at least one of the plurality of channels to block lubricant flow through the at least one of the plurality of channels, the spring biasing the valve toward the first orientation.

9. The drive system of claim 8, wherein the inertial valve is moveable between the first orientation and the second orientation in response to rotation of the piston about the axis.

10. The drive system of claim 9, wherein the piston is rotatable about the axis in a first rotational velocity and a second rotational velocity, the second rotational velocity being greater than the first rotational velocity, the spring biasing the inertial valve toward the first orientation when the piston is rotating at the first rotational velocity, and wherein the inertial valve is moveable toward the second orientation when the piston is rotating at the second rotational velocity.

11. The drive system of claim 8, wherein the drive system is coupled to a rotary tool and the housing has a forward end, the rotary tool including a motor supported in the housing and having a motor shaft and an output shaft supported in the forward end, and wherein the frame is coupled to the motor shaft and is rotatable relative to the housing about the axis in response to rotation of the motor shaft.

12. The drive system of claim 11, wherein the piston is engageable with the output shaft to hammer the output shaft about the axis.

13. The drive system of claim 11, wherein the piston cammingly engages the output shaft, and wherein during camming engagement, the inertial valve moves from the first position toward the second position.

14. The drive system of claim 8, wherein the piston is moveable between a forward position and a rearward position, the inertial valve being in the first orientation when the piston is in the rearward position.

15. The drive system of claim 8, wherein the piston is moveable between a forward position and a rearward position, the inertial valve being in the second orientation when the piston is in the forward position.

16. A drive system having a housing, the drive system comprising:

a frame supported in the housing and defining an axis, the frame being rotatable about the axis, the frame defining an interior space and housing lubricant;

a piston supported by the frame and being moveable axially in the interior space between a forward position and a rearward position, the piston dividing the interior space and defining a first chamber, a second chamber, and a plurality of channels communicating between the first chamber and the second chamber; and an inertial valve coupled to the piston, the inertial valve being moveable between a first orientation, in which at least a portion of the valve is spaced a distance from at least one of the plurality of channels to permit lubricant flow along the at least one of the plurality of channels, and a second orientation, in which the inertial valve sealingly engages the at least one of the plurality of channels, the inertial valve being moveable between the first orientation and the second orientation in response to movement of the piston between the forward position and the rearward position.

17. The drive system of claim 16, wherein the inertial valve includes a spring, and wherein the spring biases the inertial valve toward the first orientation.

18. The drive system of claim 17, wherein the piston is rotatable about the axis in a first rotational velocity and a second rotational velocity, the second rotational velocity being greater than the first rotational velocity, the spring biasing the inertial valve toward the first orientation when the piston is rotated at the second rotational velocity, and wherein the inertial valve is moveable toward the second orientation when the piston is rotated at the first rotational velocity.

19. The drive system of claim 16, wherein an inertial force moves the valve from the first orientation toward the second orientation.

20. The drive system of claim 16, wherein the inertial valve includes a valve stop, the valve stop being sealingly engageable with the piston to seal the at least one of the plurality of channels when the inertial valve is in the second orientation and being moveable away from the piston when the inertial valve is moved toward the first orientation.

21. The drive system of claim 16, wherein the drive system is supported in a housing of a rotary tool, the housing having a forward end, the rotary tool including a motor supported in the housing and having a motor shaft and an output shaft supported in the forward end, and wherein the frame is coupled to the motor shaft and is rotatable relative to the housing about the axis in response to rotation of the motor shaft.

22. The drive system of claim 21, wherein the piston is engageable with the output shaft to hammer the output shaft about the axis.

23. The drive system of claim 21, wherein the piston cammingly engages the output shaft, and wherein during camming engagement, the inertial valve moves from the first position toward the second position.

24. A method of operating a drive system of a rotary tool, the drive system including a frame defining an axis and enclosing an interior space, the interior space housing lubricant, a piston supported by the frame and being moveable axially in the interior space and rotatable about the axis, the piston dividing the interior space and defining a first chamber, a second chamber, and a plurality of channels communicating between the first chamber and the second chamber, and an inertial valve coupled to the piston, the inertial valve being moveable between a first orientation, in which at least a portion of the inertial valve is spaced a distance away from the plurality of channels to permit lubricant flow along the channel, and a second orientation, in which the inertial valve sealingly engages the piston, the method comprising:

rotating the piston with the frame about the axis;

moving the piston along the axis between a rearward position and a forward position; and moving the inertial valve between the first orientation and the second orientation in response to rotation of the piston about the axis.

25. The method of claim 24, wherein the inertial valve includes a spring, the spring biasing the inertial valve toward the first orientation, and wherein moving the inertial valve between the first orientation and the second orientation includes compressing the spring.

26. The method of claim 24, further comprising moving lubricant along at least one of the plurality of channels between the first chamber and the second chamber.

27. The method of claim 24, wherein moving the inertial valve between the first orientation and the second orientation includes stopping rotation of the piston about the axis.

28. The method of claim 24, wherein the housing has a forward end, the forward end supporting an output shaft for rotation about the axis, and the method further comprising cammingly engaging the output shaft with the piston to rotate the output shaft about the axis.

29. The method of claim 24, wherein the rotary tool includes a motor supported in the housing and having a motor shaft, and the method further comprising:

rotating the motor shaft about the axis; and transferring rotational motion from the motor shaft to the frame to rotate the frame about the axis.

* * * * *